US011939106B2

(12) United States Patent
Guilloux et al.

(10) Patent No.: US 11,939,106 B2
(45) Date of Patent: Mar. 26, 2024

(54) EASY TO FORM PACKAGE

(71) Applicant: PA. COTTE SA, Pully (CH)

(72) Inventors: Simon Guilloux, Vertou (FR); Pascal Hugues, Orvault (FR)

(73) Assignee: PA. COTTE SA, Pully (CH)

( * ) Notice: Subject to any disclaimer, the term of this patent is extended or adjusted under 35 U.S.C. 154(b) by 0 days.

(21) Appl. No.: 18/017,269

(22) PCT Filed: Jul. 21, 2021

(86) PCT No.: PCT/EP2021/070418
§ 371 (c)(1),
(2) Date: Jan. 20, 2023

(87) PCT Pub. No.: WO2022/023143
PCT Pub. Date: Feb. 3, 2022

(65) Prior Publication Data

US 2023/0192357 A1 Jun. 22, 2023

(30) Foreign Application Priority Data

Jul. 27, 2020 (FR) ..... 2007904

(51) Int. Cl.
*B65D 6/18* (2006.01)

(52) U.S. Cl.
CPC .. *B65D 11/1833* (2013.01); *B65D 2251/1016* (2013.01)

(58) Field of Classification Search
CPC . B65D 11/1833; B65D 11/184; B65D 11/186; B65D 11/18; B65D 55/02;
(Continued)

(56) References Cited

U.S. PATENT DOCUMENTS 845,596 A * 2/1907 Thieler
1,005,876 A * 10/1911 Reeser ..... B65D 11/1833 292/259 R (Continued)

FOREIGN PATENT DOCUMENTS

| | | |
|---|---|---|
| DE | 1289479 | 2/1969 |
| JP | 2009-102079 | 5/2009 |
| WO | 2020/104339 | 5/2020 |

OTHER PUBLICATIONS

International Search Report and Written Opinion as issued by the International Searching Authority, dated Sep. 16, 2021, for International Patent Application No. PCT/EP2021/070418; 14 pages.

(Continued)

*Primary Examiner* — Stephen J Castellano
(74) *Attorney, Agent, or Firm* — Faegre Drinker Biddle & Reath LLP

(57) ABSTRACT

A foldable package includes a box defining a stowage volume, the box having a bottom and a peripheral rim including: a first panel; a second panel opposite to the first panel; a third panel; a fourth panel opposite to the third panel. The box is able to adopt: a stowage configuration in which each panel extends substantially parallel to the bottom; and an operating configuration in which each panel, of the second panel, of the third panel and of the fourth panel extends substantially perpendicular to the bottom. The package further includes a mechanism for returning the first panel and the second panel into the operating position, tending to make them pass from their stowage position to their operating position in the inactive position of the locking mechanism.

4 Claims, 8 Drawing Sheets

(58) Field of Classification Search
CPC .... B65D 43/164; B65D 43/163; B65D 43/16; B65D 2251/1016
USPC ..... 220/6
See application file for complete search history.

(56) References Cited

U.S. PATENT DOCUMENTS

| | | | | |
|---|---|---|---|---|
| 2,291,888 | A | 8/1942 | Ericksen | |
| 2,844,272 | A | 7/1958 | Mayer | |
| 7,455,345 | B1 * | 11/2008 | Kim | B60J 1/2019 296/97.4 |

OTHER PUBLICATIONS

English translation of International Search Report as issued by the International Searching Authority, dated Sep. 16, 2021, for International Patent Application No. PCT/EP2021/070418; 2 pages.
English translation of the Written Opinion as issued by the International Searching Authority, dated Sep. 16, 2021, for International Patent Application No. PCT/EP2021/070418; 6 pages.

* cited by examiner

EASY TO FORM PACKAGE

CROSS-REFERENCE TO RELATED APPLICATIONS

The present application is a national stage entry of International (PCT) Patent Application Number PCT/EP2021/070418, filed Jul. 21, 2021, which claims priority to French Patent Application Number 2007904, filed Jul. 27, 2020, the complete disclosures of which are expressly incorporated herein by reference.

The field of the invention is that of logistics.

More precisely, the invention relates to the design and the manufacture of foldable packages with facilitated forming.

In the field of logistics, packages are largely used to allow routing objects between two destinations.

More particularly, packages are advantageously used for sending objects with small volume such as shoes, decorative articles or small equipment.

These packages, generally cardboard boxes, allow storing and protecting objects during their transport and facilitating manipulation by transporters during the loading and unloading phases of trucks.

Moreover the packages, and particularly the size of the packages, allow being able to facilitate the stowage of the different cardboard boxes in a limited space such as for example the loading portion of a small truck, or the interior of a container.

The packages are advantageously formed from foldable cardboard boxes such that, when the package is not in use, the carton is stored folded so as not to take up space.

Hence, when an object must be sent, it is necessary to form a cardboard box to form a package.

Generally, a package comprises a box and a lid intended to close the box.

The box then forms a stowage space in which at least one object is intended to be placed.

To secure the sending and the routing of the objects, holding and/or protection means can be provided inside the stowage space.

These conventionally known holding means can take the form of a film rigidly attached to the bottom of the box or even, if only means of protection are involved, pieces of crumpled paper, bubble wrap or polystyrene beads for example.

Other solutions such as inflatable pockets can also be used.

Conventionally, the box of the package comprises a bottom and a peripheral rim protruding from the bottom.

More particularly, the peripheral rim comprises:

a first panel;

a second panel opposite to the first panel;

a third panel;

a fourth panel opposite to the third panel.

To form the box, the user must use both hands.

In fact, when the box is a cardboard box, all the panels forming the peripheral rim forming the peripheral rim are coupled two by two by hinges and the bottom generally comprises several folds intended to be folded upon one another and/or in the continuation of the others, to form an installation plane of the package.

Thus, when the user forms the cardboard box, he seizes at least two opposite panels to form a parallelepiped which defines the peripheral rim, then uses and manipulates the different flaps to form the bottom of the box. He can then use adhesive means to hold in position the panels of the peripheral rim [text missing] with respect to the bottom.

In order to avoid a manipulation of this type, particularly to have to form the bottom of the box, solutions have been developed.

By way of an example, boxes can comprise a single-piece bottom and panels each of which is movable with respect to the bottom of the box to allow flattening the box or, on the contrary, forming the box for the purpose of its use.

Thus, the box can adopt:

a stowage configuration in which each of the first panel, of the second panel, of the third panel and of the fourth panel extends substantially parallel to the bottom;

an operational configuration in which each of the first panel, of the second panel, of the third panel and of the fourth panel extends substantially perpendicular to the bottom.

To facilitate the forming of the box, solutions have also been developed.

By way of an example, the panels of the peripheral edges can be connected together by driving means allowing the other panels to follow the movement of the manipulated panel when one of the panels is manipulated, this to pass from their position in which they extend parallel to the bottom to their position in which they extend substantially perpendicular to the bottom.

The forming of the box is then facilitated because the manipulation of a single panel causes the movement of the other panels.

This solution is not without disadvantages, however.

In fact it is possible, in certain cases, that too sudden or too rapid a manipulation of the panel causes an uncontrolled movement of the other panels, which may then either jam, preventing the total formation of the box, or on the contrary be blocked or damaged.

Thus the user is obliged to resort to both hands to manipulate two panels instead of only one, so as to ensure the proper formation of the box, to the detriment of the speed of formation of the box.

In addition, such solutions do not prevent each of the panels from reverting to its position in which it extends substantially parallel to the bottom, in the absence of holding by the user.

Solutions exist, however, for avoiding such a position reversion by the panels, these solutions then implementing means for retaining the panels in their position substantially perpendicular to the bottom.

These means are generally mechanical and then require the user to resort to both hands to implement them.

The invention particularly has as its object mitigating the disadvantages of the prior art.

More precisely, the invention has as its object proposing a solution which allows facilitating the forming of packages for their use, in particular by proceeding with one hand only.

The invention also has as its object supplying a solution of this type which is reliable and easy to use.

The invention also has as its object supplying a solution of this type which prevents the involuntary folding of the box.

These objects, as well as others that will appear later, are attained due to the invention, which has as its object a foldable package comprising a box defining a stowage volume, the box having a bottom and a peripheral rim comprising:

a first panel;

a second panel opposite to the first panel;

a third panel;

a fourth panel opposite to the third panel, the box being able to adopt:

a stowage configuration in which each of the first panel, of the second panel, of the third panel and of the fourth panel extends substantially parallel to the bottom;

an operating configuration in which each of the first panel, of the second panel, of the third panel and of the fourth panel extends substantially perpendicular to the bottom;

characterized in that, in the stowage configuration:

the first panel and the second panel are folded over the bottom of the box;

the third panel is folded over the first panel and the second panel;

and in that the package comprises means for returning the first panel and the second panel into the operating position, tending to make them pass from their stowage position to their operating position in the inactive position of the locking means.

The presence of the return means in the operating position of the first panel and of the second panel allows a user to be able to use the package easily, particularly for its passage from the stowage position to its operating position.

In fact, due to the presence of return means, the forming of the box is automatic, or nearly so.

More particularly, the first panel, the second panel and the third panel can be put in their position substantially perpendicular to the bottom solely by the manipulation of the third panel by the user to disengage it from the first and from the second panel, this manipulation being able to be carried out by mobilizing only one hand.

The return means then act on the first panel and the second panel to progressively move them from their position substantially perpendicular to the bottom as the third panel itself is positioned in its position substantially perpendicular to the bottom.

The forming of the box can then be terminated by the positioning, substantially perpendicular to the bottom, of the fourth panel.

According to an advantageous embodiment, the package comprises locking means which can adopt:

an active position in which they hold the third panel in the stowage configuration of the box, an inactive position in which they leave the third panel free to move.

The inactive positioning of the locking means can allow the forming of the box by the positioning of the first panel and of the second panel substantially perpendicular to the bottom.

By the sole manipulation of the locking means, and due to an adequate setting of the return means, the concomitant movement of the first panel, of the second panel and of the third panel can be accomplished.

Advantageously, the package also comprises a lid to close the stowage volume of the box.

A lid of this type allows isolating the stowage volume, defined by the bottom and the peripheral rim of the box, from its surrounding environment, and thus protecting the objects which are housed in the stowage volume.

Preferably, the lid is mounted in rotation on one of the panels of the box.

This configuration then allows facilitating the use and the manipulation of the package.

In fact, the lid being rigidly connected to the peripheral rim, it is not necessary for the user to stow it separately from the box.

Moreover, the manipulation of the lid to allow or prevent access to the stowage volume of the box is then facilitated because it is sufficient for the user to pivot the lid with respect to the peripheral rim.

According to a preferred embodiment, the lid is mounted in rotation on the fourth panel.

Thus, during the forming of the box, it is sufficient for the user to disengage the fourth panel and the lid with respect to the first panel, to the second panel and to the third panel to allow the automatic, or nearly automatic forming of the box, and by inactively positioning the locking means if necessary, this still possibly with only one hand.

The user can, by only the manipulation of the lid and of the fourth panel, easily terminate the forming of the box.

In this case, in the stowage configuration of the box, the fourth panel is advantageously in the continuation of the bottom of the box and the lid is advantageously folded over the fourth panel, the first panel and the second panel, and extends in the continuation of the third panel.

This thus allows obtaining a compact package in its stowage configuration.

More precisely, the lid not covering the third panel, there are then only two thicknesses of panels above the bottom of the box, which favors its compactness in its stowage configuration.

According to a preferred embodiment, the locking means comprise a first portion inseparably connected to or integral with the third panel and a second portion rigidly connected to the bottom of the box.

Thus, the locking means allow ensuring that, in its stowage configuration, only the voluntary action of a user can allow the forming of the box.

In addition, it allows guaranteeing holding in the stowage configuration of the box under all circumstances.

In fact, the third panel remains substantially parallel to the bottom of the box, even if the box is stored vertically.

In fact, cooperation between the third panel and the bottom of the box via locking means prevents, even in the presence of well-set return means, the passage of the first panel and of the second panel into their position substantially perpendicular to the bottom.

Preferably, the return means comprise at least one first torsion spring interleaved between the bottom and the first panel of the box, and a second torsion spring interleaved between the bottom and the second panel of the box.

Thus, each of the first panel and of the second panel is automatically, and independently of the other, moved into its position substantially perpendicular to the bottom by the force exerted by each of the torsion springs.

Thus, even if one of the return means is more weakly set than the other, at least one of the first panel and of the second panel can be automatically positioned substantially perpendicular to the bottom of the box, which causes the positioning of the third panel in its position substantially perpendicular to the bottom and consequently allows placing the other of the second panel and of the first panel in its position substantially perpendicular to the bottom automatically.

Advantageously, each torsion spring comprises a first branch rigidly connected to the bottom of the box, and a second branch rigidly connected to the first panel or to the second panel, the first branch and the second branch being connected to one another by a succession of turns.

Such torsion springs are simple to manufacture and to set.

In fact, in a convention and known manner, such torsion springs can be obtained by dedicated manufacturing machines.

In addition, these springs are simple to implement because each branch then cooperates either with one of the first panel and of the second panel, or with the bottom of the box, so as to be able to be housed there and poorly visible, therefore having few consequences on the stowage volume inside the box.

In this case, the bottom, the first panel and the second panel of the box advantageously each have a recess for receiving at least partially the return means.

The torsion springs can then be housed in the receiving recesses to be able to be virtually submerged in the material forming the bottom and the panels of the box.

Thus, the stowage volume of the box is not reduced by the presence of the torsion springs, and the movement of the first panel and of the second panel is thereby facilitated due to the torsion springs.

In addition, the torsion springs are protected, which allows making the use of the package more reliable over time, and particularly being able to allow the passage of the box from its stowage configuration to its operating configuration, or conversely, over the long term.

Other features and advantages of the invention will appear more clearly upon reading the following description of preferred embodiments of the invention, given by way of illustrative and non-limiting examples, and the appended drawings, among which:

Figure 1:
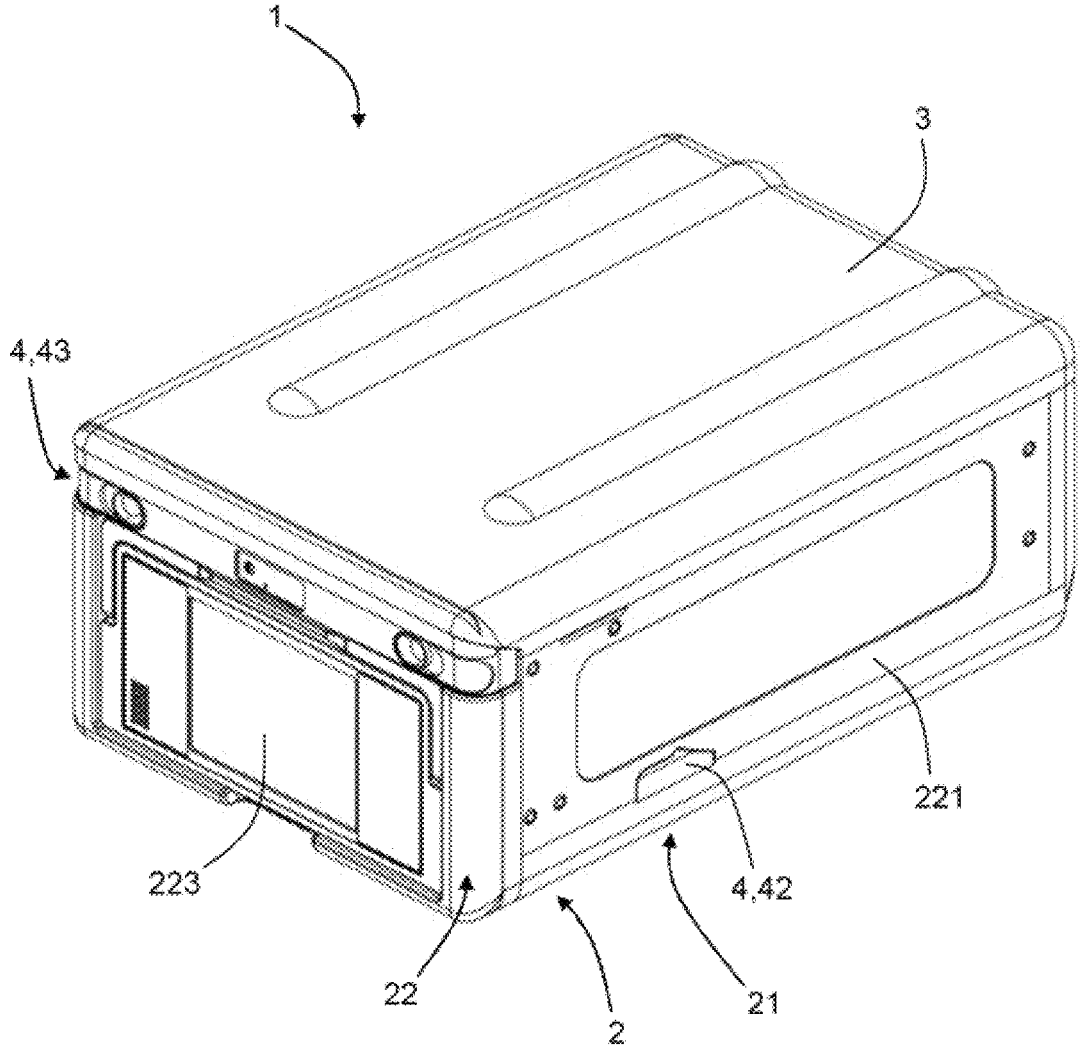
FIG. 1 is a perspective top view of a package according to the invention, in an operating configuration of the box.

With reference to FIGS. 1 to 6 and 8, a package 1 according to the invention is shown.

The package 1 comprises a box 2 and a lid 3.

The package 1 is foldable. To this end, the box 2 is foldable between an operating configuration and a stowage configuration.

In the operating configuration, the box 2 defines a stowage volume inside which can be placed one or more objects for the purpose of their routing from a departure point to an arrival point.

The lid 3 is movable with respect to the box 2 and allows being able to close the box 2 to prevent access to the stowage volume.

Thus, by placing or removing the lid, it is possible to either prevent access to the stowage volume, or allow access to the stowage volume.

As illustrated in FIGS. 1, 4, 5 and 7 in particular, the box 2 has a bottom 21 and a peripheral rim 22.

Figure 4:
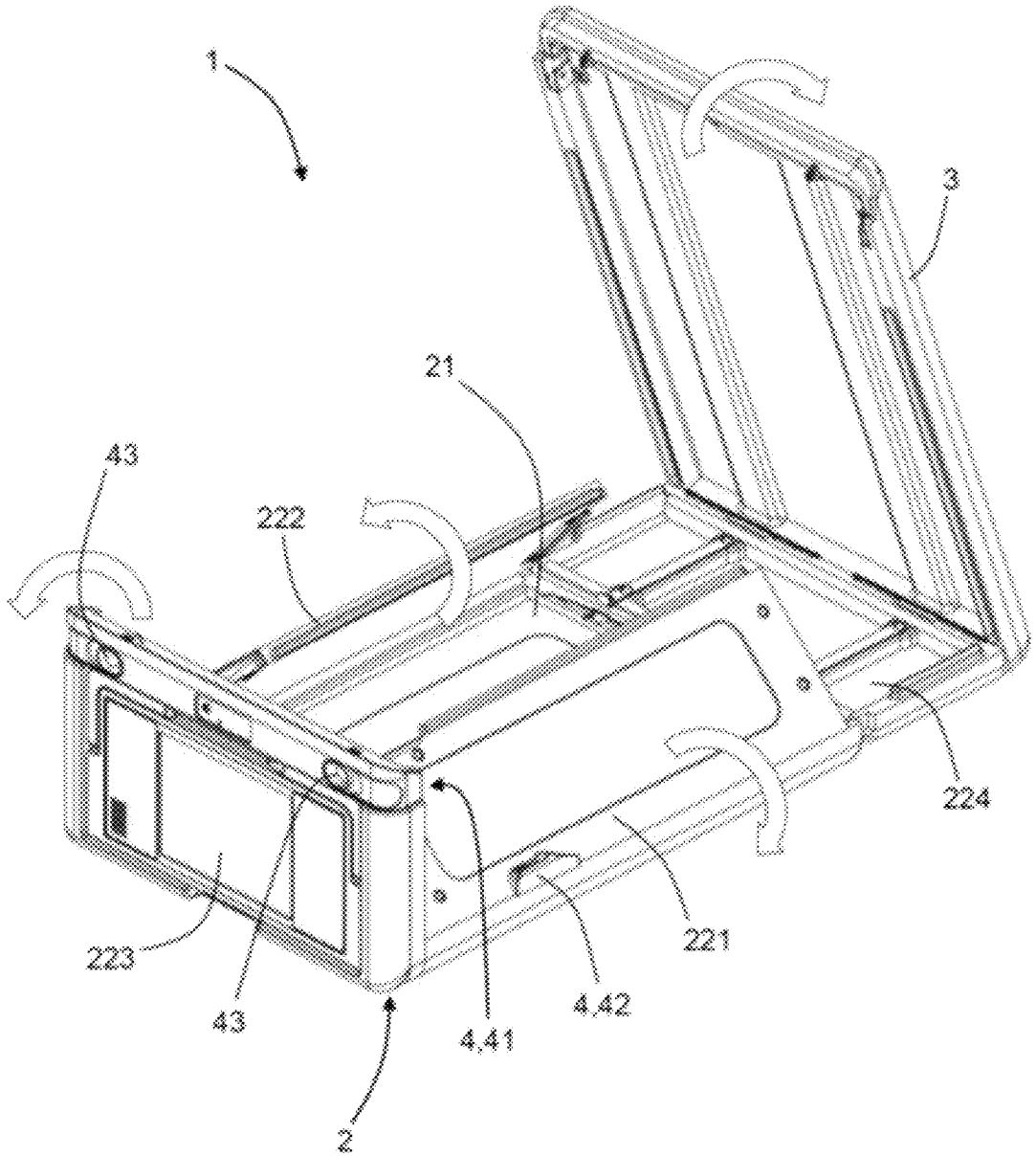
FIG. 4 is a perspective top view showing the package according to the invention during forming into an operating configuration of the box, from its stowage configuration.

More particularly, and with reference to FIG. 4, the peripheral rim 22 comprises:

a first panel 221;

a second panel 222 opposite to the first panel 221;

a third panel 223;

a fourth panel 224 opposite to the third panel 223.

Figure 2:
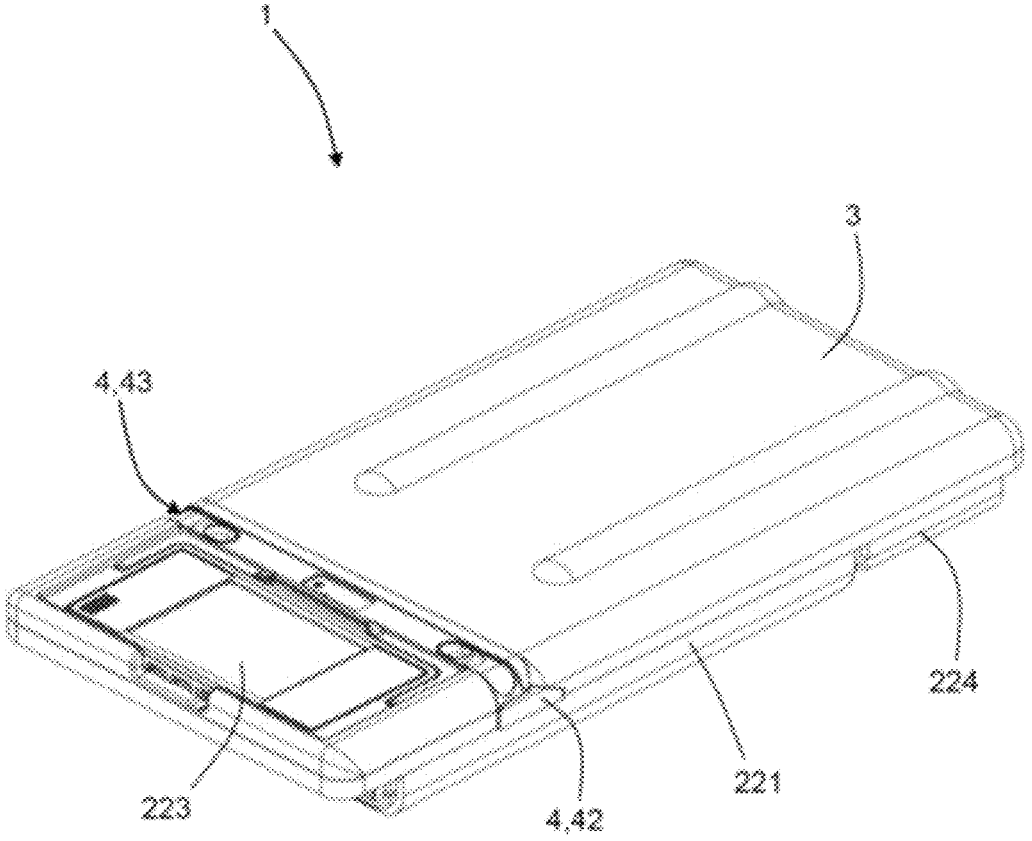
FIG. 2 is a perspective top view of the package according to the invention in a stowage configuration.
Figure 3:
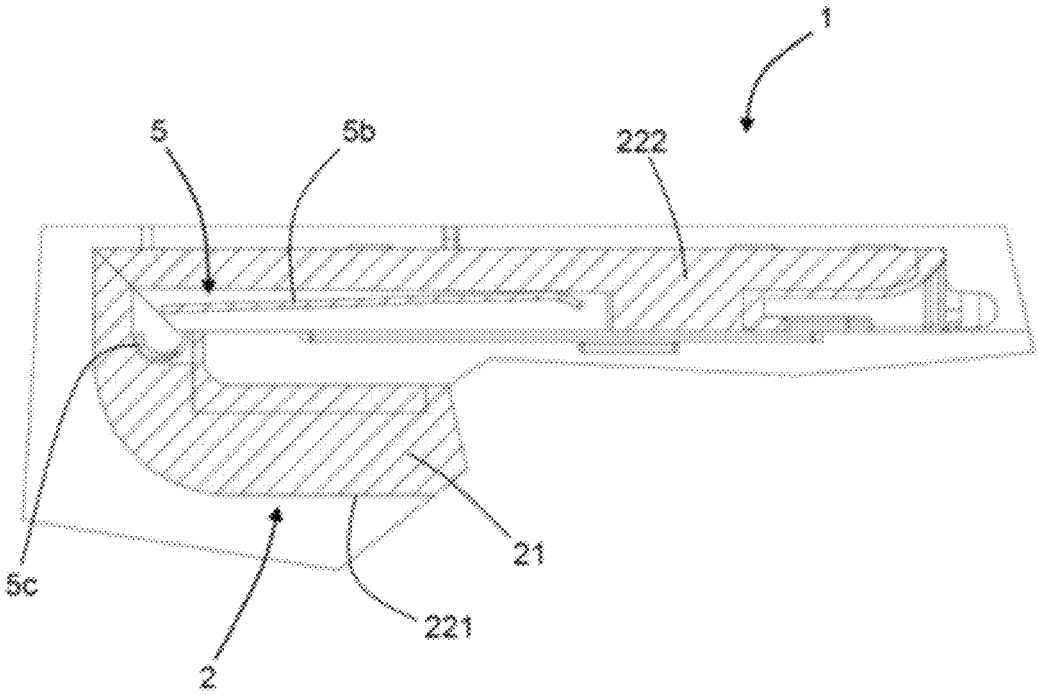
FIG. 3 is a detail section view of the package according to the invention, in its stowage configuration.
Figure 7:
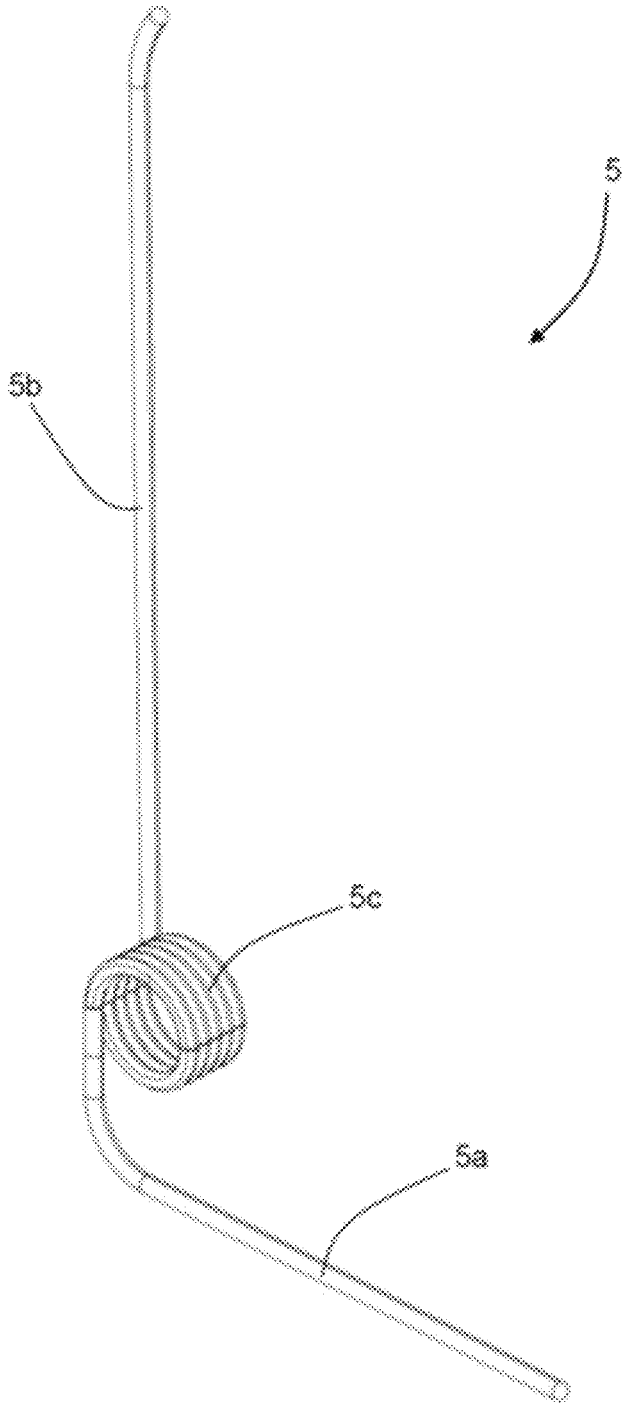
FIG. 7 is a perspective top view of a torsion spring forming the return means of the package according to the invention.

The box 2 can adopt the stowage configuration as illustrated in FIGS. 2 and 7 in which each of the first panel 221, of the second panel 222, of the third panel 223 and of the fourth panel 224 extends substantially parallel to the bottom 21.

Figure 6:
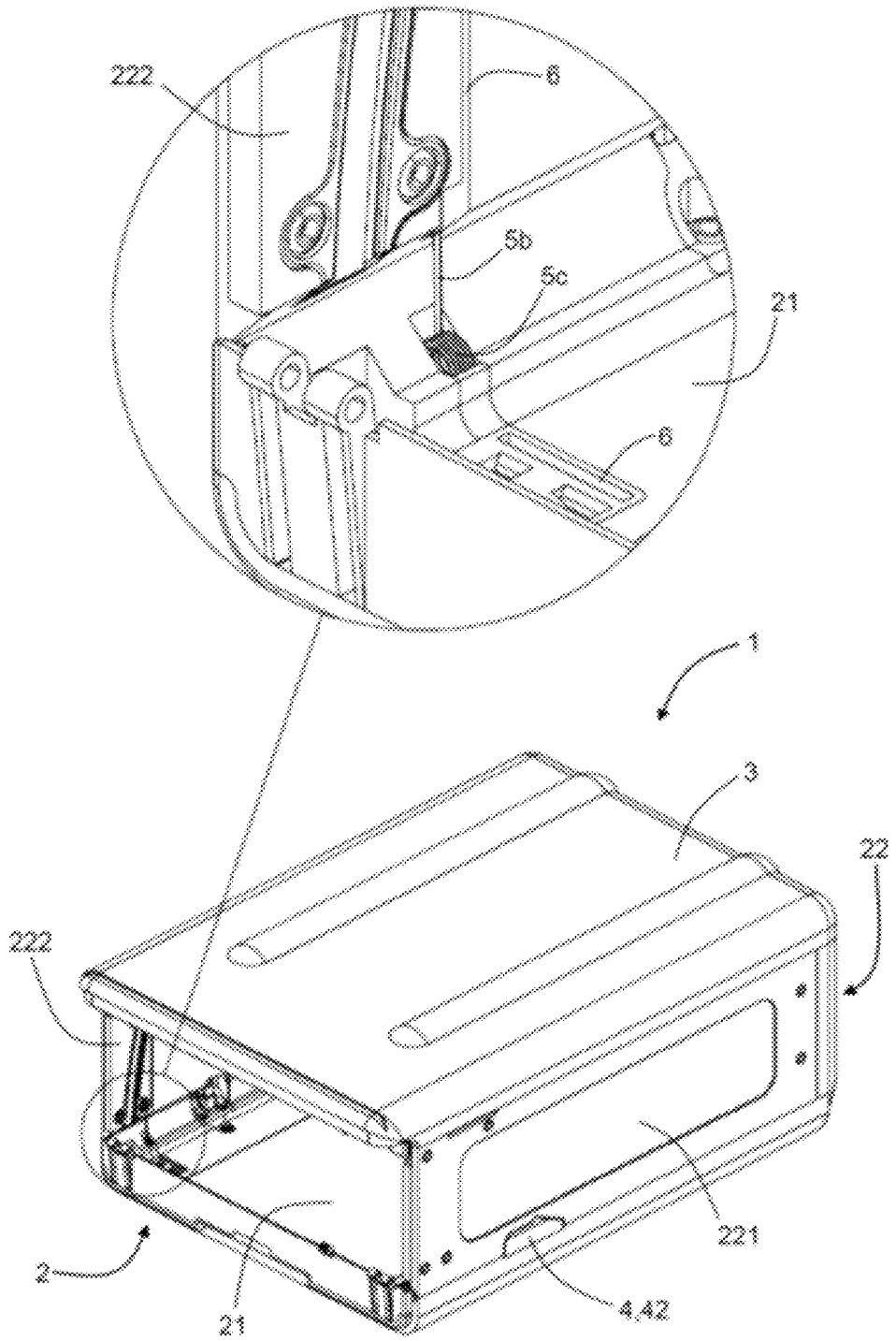
FIG. 6 is a perspective top view of the package according to the invention, in a simplified representation, and comprising a detail inset at larger scale.

In parallel, as illustrated in FIGS. 1 and 6 in particular, the box 2 can adopt the operating configuration in which each of the first 221, of the second panel 222, of the third panel 223 and of the fourth panel 224 extends substantially perpendicular to the bottom 21.

The lid 3, as illustrated in FIGS. 1, 4 and 6, is rigidly connected to the peripheral rim 22.

More precisely, the cover 3 is mounted movable in rotation on one of the panels 221, 222, 223, 224 of the peripheral rim 22.

Preferably, the lid 3 is mounted in rotation on the fourth panel 224 of the peripheral rim 22.

With reference to FIG. 2, in the stowage configuration of the box 2:

- the first panel 221 and the second panel 222 are folded over the bottom 21 of the box 2;
- the third panel 223 is folded over the first panel 221 and the second panel 222;
- the fourth panel 224 extends in the continuation of the bottom 21 of the box 2;
- the lid 3 is folded over the fourth panel 224, the first panel 221 and the second panel 222, and extends in the continuation of the third panel 223.

To allow holding in position or in the stowage configuration of the box 2, the package 1 comprises locking means 4 which can adopt an active position in which they hold the third panel 223 in the stowage position of the box 2 and an inactive position in which they leave the third panel 223 free to move.

More precisely, with reference to FIG. 4, the locking means 4 comprise a first portion 41 inseparably connected to or integral with the third panel 223 and a second portion 42 rigidly connected to the bottom 21 of the box 2.

As illustrated in FIG. 4, the locking means 4 comprise a female member forming the first portion 41 and rigidly connected to the third panel 223 and at least one male member rigidly connected to the bottom 21 of the box 2, and intended to cooperate with the female member.

Control means 43 are also provided on the third panel 223 to allow controlling the female member between an active state in which the female member holds captive the male member and an inactive state in which the female member leaves free the insertion or the withdrawal of the male member from the female member.

Figure 8:
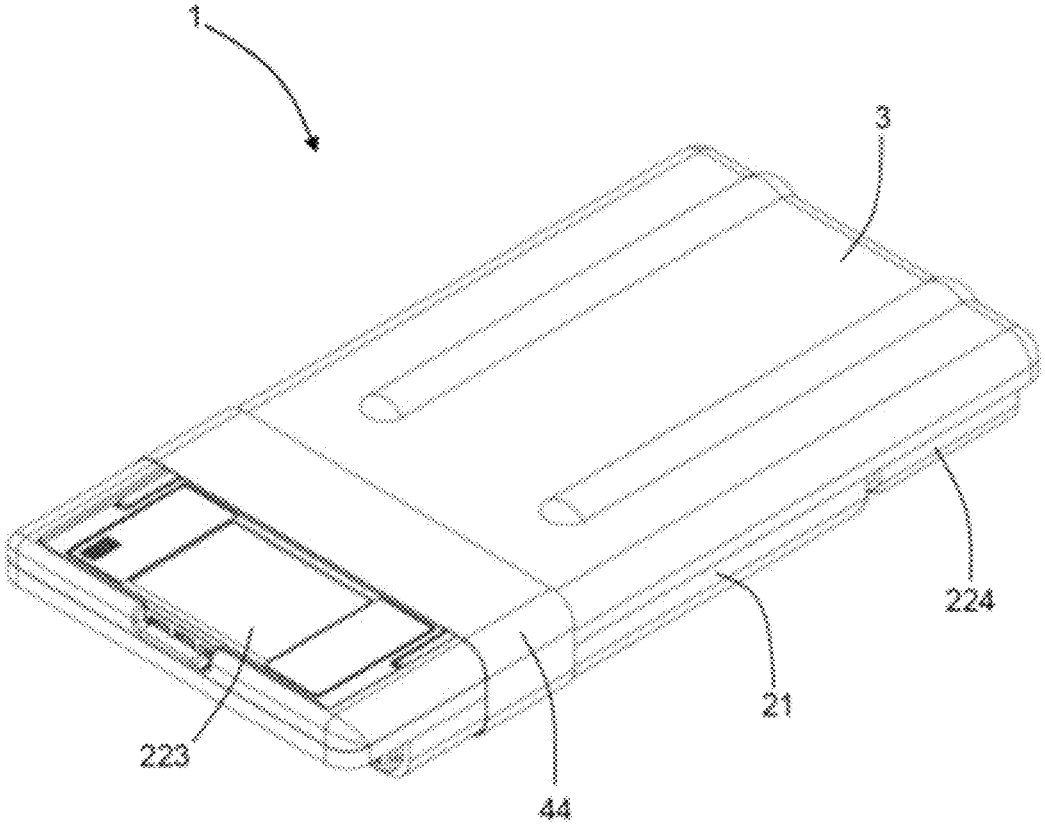
FIG. 8 is a perspective view from above of the package according to the invention, according to one variant embodiment.

According to a variant embodiment illustrated in FIG. 8, the locking means 4 comprise an elastic strip 44 intended to girdle the box 2 in its stowage configuration.

More particularly, the elastic strip is intended to be deformed by a user to be positioned around the box 2 and, while tending to recover a shape that is not elastically deformed, girdle and hold, in the stowage configuration of the box 2, the third panel 223 while covering the first panel 221 and the second panel 222.

As illustrated in FIG. 8, the elastic strip 44 has a width such that it can be mounted on the box 2 so as to partially cover the third panel 223 and the cover 3.

When it is covering at least the third panel 223, the elastic strip 44 is in its active position, while when it is withdrawn from the box and therefore no longer covers the third panel 223, the elastic strip 44 is in its inactive position.

This allows facilitating the storage of the package 1, and particularly preventing any undesired deployment of the lid 3 during storage or transport of the unformed package 1.

To facilitate the forming of the box 2, i.e. its passage from its stowage configuration to its operating configuration, the box 2 comprises means 5 for returning into a position substantially perpendicular with respect to the bottom 21 of the first panel 221 and of the second panel 222 of the peripheral rim 22.

More particularly, the package 1 comprises means 5 for returning the first panel 221 and the second panel 222 into their operating position, tending to make them pass from their stowage position to their operating position.

This passage of the first panel 221 and of the second panel 222 into their operating position is then possible from the moment that the locking means 4 are in their inactive position.

In fact, when the locking means 4 are in their active position, they ensure the holding of the third panel 223 covering the first panel 221 and the second panel 222, thus preventing their movement.

More particularly, the return means 5 comprise at least one first torsion spring 51 and a second torsion spring 52.

Figure 5:
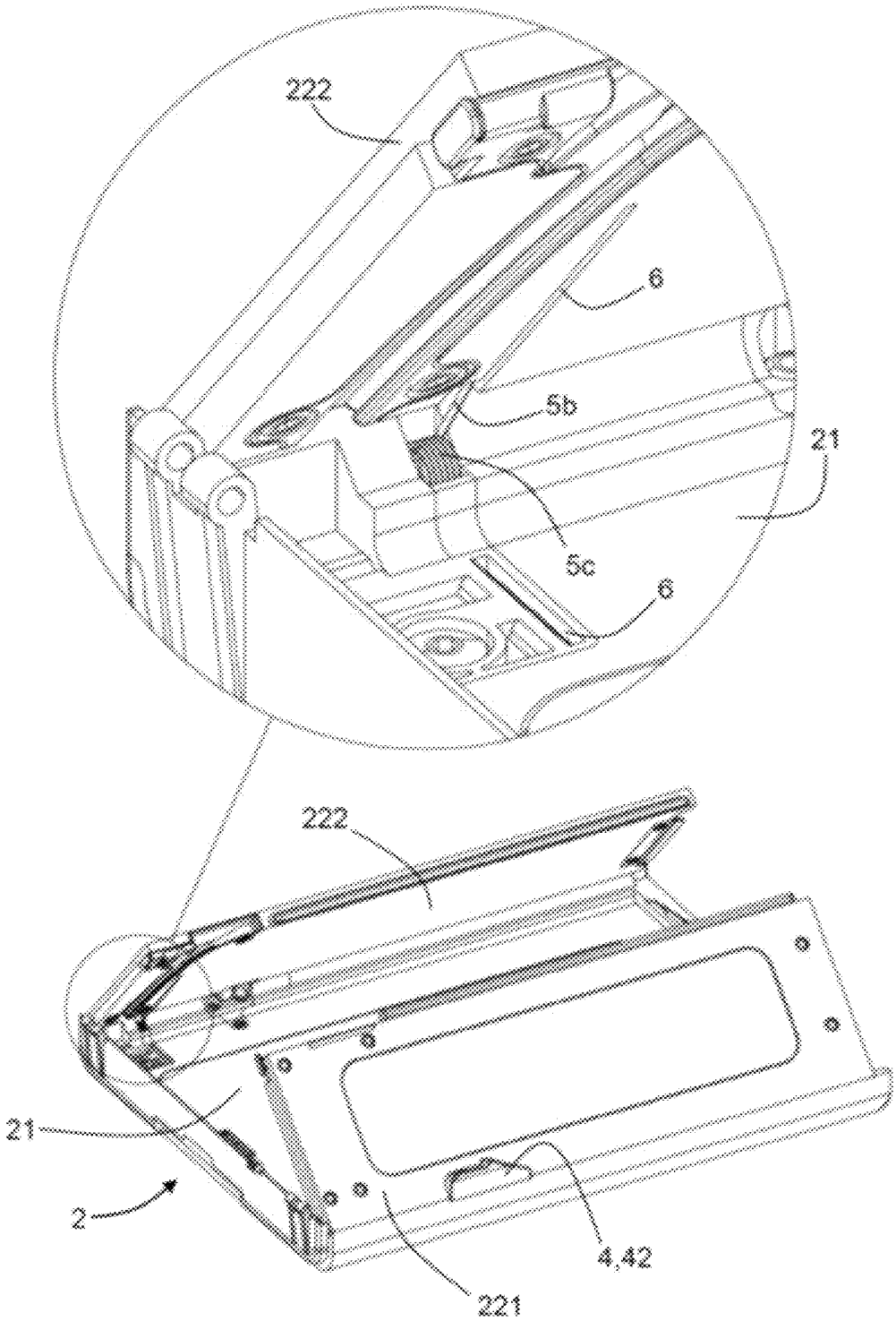
FIG. 5 is a simplified perspective top view of the package according to the invention, comprising a detail inset illustrating means for returning into position the panels of the box.

The first torsion spring 51 is mounted between the first panel 221 and the bottom 21 of the box 2, and the second torsion spring 52 is mounted between the second panel 222 and the bottom 21 of the box 2, as illustrated in particular in FIGS. 5 and 6.

With reference to FIG. 7, each torsion spring 51, 52 comprises a first branch 5*a*, a second branch 5*b*, connected to one another by a succession of turns 5*c*.

When it is mounted in the box, each of the first torsion spring 51 and the second torsion spring 52 is integrated into the bottom 21 of the box 2, on the one hand, and into one of the first panel 221 and of the second panel 222 on the other hand.

More precisely, the first branch 5*a* is intended to be rigidly connected to the bottom 21 of the box 2, and the second branch 5*b* is intended to be rigidly connected to the first panel 221 or to the second panel 222.

By setting the turns 5*c*, i.e. for example their number and their diameter, it is thus possible to determine and to shape the torsion springs 51, 52 to allow positioning of the box 2, and particularly deployment of the first panel 221 and of the second panel 222 at a desired speed.

With reference to the detail inset of FIGS. 5 and 6, each of the first panel 221 and of the second panel 222, as well as the bottom 21 of the box 2, has a recess 6 for receiving at least partially the return means 5.

More particularly, the receiving recesses 6 appear in the form of grooves within which are housed one of the first branch 5*a* and of the second branch 5*b* of one of the torsion springs 51, 52.

The turns 5*c*, as illustrated in the detail insets, are also housed in the bottom 21 off the box 2.

In operation, to form a package 1 according to the invention, a user seizes the package 1 in its stowage configuration, as illustrated in FIG. 2.

In a first step, the user actuates the actuation means 43 or removes the elastic strip 44 to position the locking means 4 in their inactive position, which allows making the third panel 223 movable and possibly the lid 3.

The user can then position the lid 3 substantially perpendicular to the fourth panel 224, so as to free at least partially the first panel 221 and the second panel 222.

The user then acts on the third panel 223 to position it substantially perpendicular to the bottom 21 of the box 2.

As illustrated in FIG. 4, due to the presence of the return means 5, the manipulation of the third panel 223 of the box 2 allows freeing the first panel 221 and the second panel 222, which can then automatically attain their position substantially perpendicular to the bottom 21 of the box 2.

The user can then manipulate the lid 3 and/or the fourth panel 224 to position the latter substantially perpendicular to the bottom 21 of the box 2, and thus form the peripheral rim 22 and consequently the stowage volume of the box 2.

When the box 2 is formed, the user can either close the stowage volume by positioning the lid 3 above the peripheral rim 22, or allow access to the stowage volume by leaving the lid 3 substantially in the continuation of the fourth panel 224.

The package 1 according to the invention, which has just been described, allows being able to form the box 2 rapidly and simply for a user.

In fact, by the sole manipulation of the locking means 4, then of the third panel 223 and possibly the lid 3, the box 2 is virtually formed and only a folding movement of the fourth panel 224 is necessary for closing the box 2.

Moreover, the presence of the return means 5, and their positioning in the box 2, i.e. their cooperation with each of the first panel 221 and of the second panel 222, allow making the deployment of the box 2, i.e. placing it in its operating configuration, reliable over time.

In fact, each of the first panel 221 and of the second panel 222 automatically attains its positions substantially perpendicular to the bottom 21 of the box 2 automatically.

The user can thus easily form a box 2, with only one hand if he wishes, without having to hold two opposite panels in their position substantially perpendicular to the bottom 21 in order to be able to manipulate other panels.

In addition, the box 2 facilitates the integration of the package 1 according to the invention into an automatic packing line.

In fact, the automatic deployment of each of the first panel 221 and of the second panel 222 allow rapid formation of the box 2, compatible with the high production rates achieved by automatic packing lines.

The invention claimed is:

1. A foldable package comprising a box defining a stowage volume, the box having a bottom and a peripheral rim comprising:

a first panel;

a second panel opposite to the first panel;

a third panel;

a fourth panel opposite to the third panel, the box being able to adopt:

a stowage configuration in which each of the first panel, the second panel, the third panel, and the fourth panel extends substantially parallel to the bottom;

an operating configuration in which each of the first panel, the second panel, the third panel, and the fourth panel extends substantially perpendicular to the bottom;

wherein, in the stowage configuration:

the first panel and the second panel are folded over the bottom of the box;

the third panel is folded over the first panel and the second panel;

the package comprising means for returning the first panel and the second panel into an operating position, tending to make them pass from a stowage position to their operating position, wherein the package comprises a lid to close the stowage volume of the box, the lid being mounted in rotation on the fourth panel, wherein, in the stowage configuration of the box, the fourth panel is in the continuation of the bottom of the box and the lid is folded over the fourth panel, the first panel and the second panel, and extends in the continuation of the third panel, and wherein the package further comprises locking means comprising a first part mounted directly to the third panel and a second part mounted directly to the bottom of the box, wherein the locking means are configured to adopt:

an active position wherein the first part and the second part are coupled to each other and lock the third panel in the stowage configuration of the box, an inactive position wherein the first part and the second part are uncoupled from each other and leave the third panel free to move with respect to the bottom of the box.

2. The package according to claim 1, wherein the return means comprise at least one first torsion spring interleaved between the bottom and the first panel of the box, and a second torsion spring interleaved between the bottom and the second panel of the box.

3. The package according to claim 2, wherein each torsion spring comprises a first branch rigidly connected to the bottom of the box, and a second branch rigidly connected to the first panel or to the second panel, the first branch and the second branch being connected to one another by a succession of turns.

4. The package according to claim 1, wherein the bottom, the first panel and the second panel of the box each have a recess for receiving at least partially the return means.

* * * * *